United States Patent [19]

Curran

[11] 4,344,410

[45] Aug. 17, 1982

[54] GAS-FIRED GUN WITH GAS CARTRIDGE LOADING AND EXTRACTION ASSEMBLY

[75] Inventor: Roger J. Curran, Stratford, Conn.

[73] Assignee: Victor United, Inc., Rogers, Ark.

[21] Appl. No.: 238,860

[22] Filed: Feb. 27, 1981

Related U.S. Application Data

[63] Continuation of Ser. No. 96,119, Nov. 20, 1979, abandoned, which is a continuation of Ser. No. 930,275, Aug. 2, 1978, abandoned.

[51] Int. Cl.[3] ..... F41B 11/06

[52] U.S. Cl. ..... 124/80; 124/74

[58] Field of Search ..... 124/74, 76, 80

[56] References Cited

U.S. PATENT DOCUMENTS

| | | | |
|---|---|---|---|
| 2,725,048 | 11/1955 | Koogle | 124/74 X |
| 3,212,489 | 10/1965 | Merz | 124/74 |
| 3,999,534 | 12/1976 | Chapin et al. | 124/74 |

*Primary Examiner*—Richard T. Stouffer

*Attorney, Agent, or Firm*—Schmidt, Johnson, Hovey & Williams

[57] ABSTRACT

A gas-fired gun having a handgrip defining a chamber for receiving a gas-containing cartridge and a lever coupled to the handgrip at its lower end for pivotal movement between positions opening and closing the chamber. The lower end of the lever carries a seat on opposite sides of which are first and second cam surfaces. The first cam surface cams the cartridge into an operative position in the chamber with its upper end in engagement with a cartridge piercing mechanism upon movement of the lever from the first to the second position. The seat enables the cartridge to back off the piercing mechanism when the lever is in the second position to improve the gas flow from the cartridge into the gas-fired gun. The second cam surface displaces the cartridge from the chamber upon movement of the lever from the second position toward its first position. A limit surface, forming part of the flat lower end of the handgrip, abuts a limit shoulder on the handgrip body to prevent movement of the lever in a direction away from the grip past its first position.

18 Claims, 5 Drawing Figures

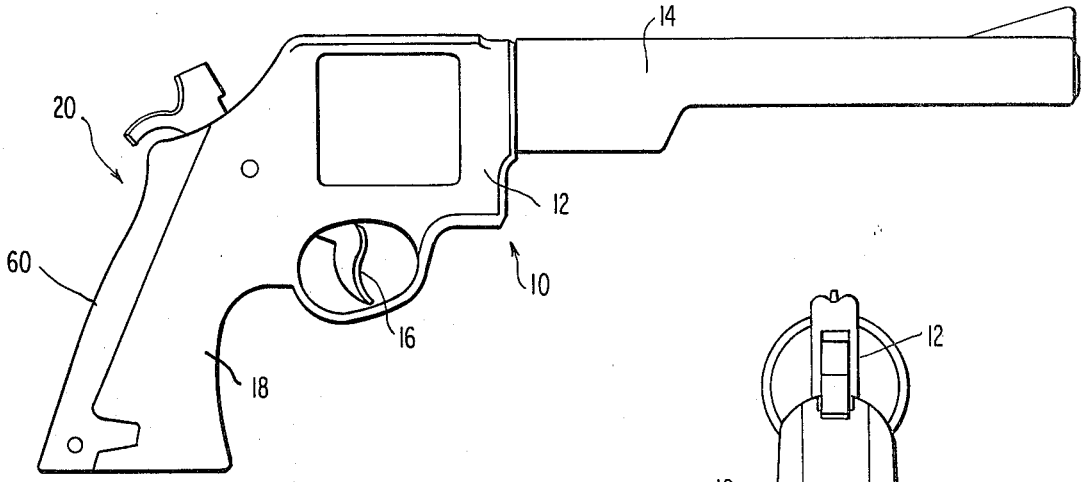
FIG. 1
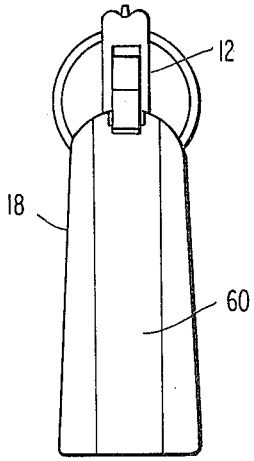
FIG. 2
FIG. 3
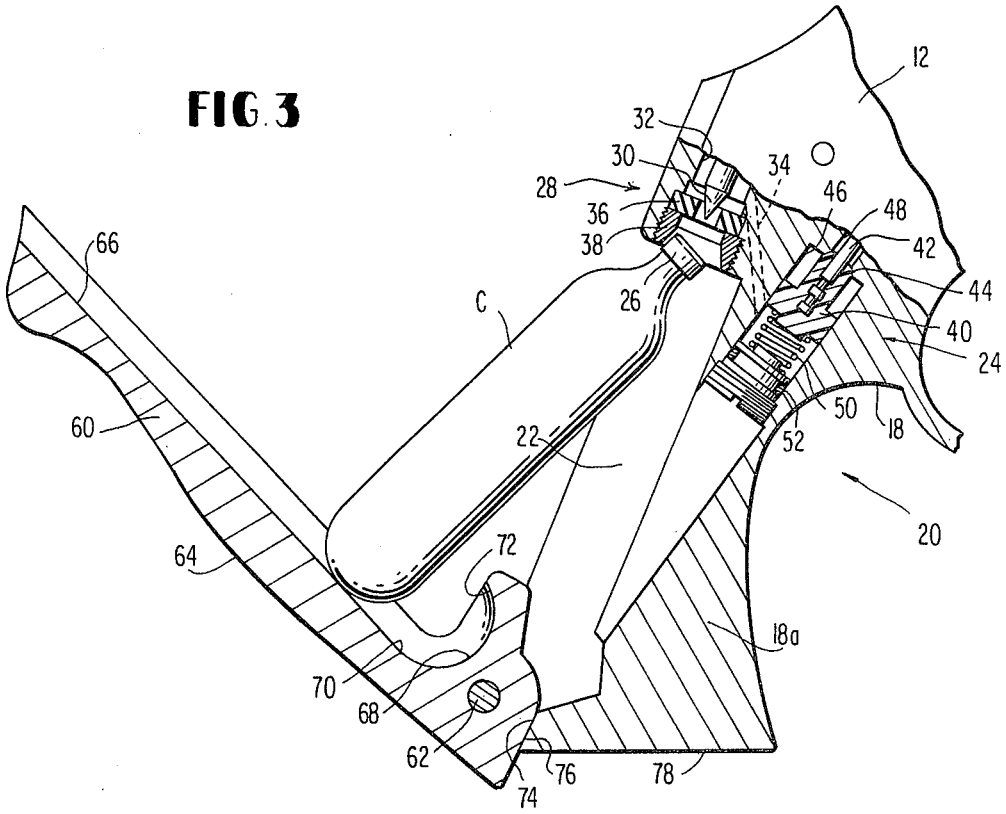

GAS-FIRED GUN WITH GAS CARTRIDGE LOADING AND EXTRACTION ASSEMBLY

This is a continuation of application Ser. No. 06/096,119, filed on Nov. 20, 1979 which is itself a continuation of prior application Ser. No. 05/930,275, filed Aug. 2, 1978 both now abandoned.

BACKGROUND OF THE INVENTION

The present invention relates to a gas-fired gun having a chamber for receiving a gas-filled cartridge. Particularly, the present invention relates to a gas-fired hand-gun having a chamber within its handgrip for receiving a gas containing cartridge and to a gas cartridge loading and extraction assembly therefor.

Various types of gas-fired guns, for example gas-fired rifles, have been proposed and constructed in the past. An example of a gas-fired rifle having a chamber for receiving a gas-filled cartridge which serves as the source of energy for firing a pellet from the rifle is described and illustrated in U.S. Pat. No. 3,999,534 of common assignee herewith. In the gas-operated rifle disclosed in that patent, a shaft carrying a concave head at one end is engageable with the bulbous end of a gas cartridge disposable into a cartridge receiving chamber carried by the rifle. By operation of a lever and a camming action when loading a gas cartridge into the rifle chamber, the head axially displaces the cartridge such that the opposite cap seal end of the cartridge is pierced by a piercing mechanism to permit gas flow into the rifle. Upon reverse movement of the lever, the shaft is spring-biased away from the piercing mechanism. This enables the cartridge to be extracted from the rifle chamber.

While this has served as a very useful mechanism for loading and extracting gas cartridges from a gas-operated rifle, different problems are involved in providing a loading and extraction assembly for gas cartridges for use in connection with gas-fired handguns. For example, the limited size of the handgun in comparison with a gas-operated rifle imposes constraints upon the location and orientation of the chamber receiving the gas cartridge as well as upon the mechanism of the gas cartridge loading and extraction assembly therefor. Also, the gas cartridge loading and extraction assembly for a gas-fired handgun must be such as to correspond to the configuration and appearance of handguns in general so as not to provide an appearance unusual for handguns.

SUMMARY OF THE INVENTION

The present invention provides a novel and improved loading and extraction assembly for gas-fired handguns which simplifies and facilitates the loading and extraction of the gas cartridge into and from a chamber located in the grip of the handgun. The operative mechanism of the loading and extraction assembly hereof includes a lever which, when the gas cartridge is loaded into the chamber and the handgun is in operative condition, forms a part of the external surface of the handgrip whereby the loading and extraction assembly hereof is adapted to the requirements of a handgun.

To load a gas cartridge into the chamber, the lever is pivoted away from the handgrip and uncovers the chamber. The cap seal end of the gas cartridge is then inserted into the upper end of the chamber which contains the cartridge piercing mechanism. The lower or bulbous end of the cartridge is simply rested on the lever in its open position. The lever is then pivoted to close the chamber. The closing action of the lever delivers the gas cartridge into the chamber and displaces it such that the piercing mechanism pierces the cap seal end of the cartridge. This closing action also permits the cartridge to back off the piercing mechanism when the cartridge is fully seated in the chamber to enlarge the gas passage in the cap seal end formed by the piercing mechanism and hence improve the flow of gas into the handgun.

To unload the spent cartridge from the chamber, the lever is moved away from the grip to uncover the chamber. This lever movement cams the spent cartridge outwardly of the chamber and also displaces the cap seal end of the cartridge away from the piercing mechanism thus facilitating removal of the cartridge.

Further, the lever is provided with a limit surface such that the motion of the lever in a direction away from the handgrip is limited to the loading position of the lever. This limit surface is arranged on the lever such that, when the lever lies in the closed position retaining the cartridge in the chamber, it forms a continuation of the flat lower surface of the handgrip.

Accordingly, it is a primary object of the present invention to provide a gas-fired handgun having a novel and improved gas cartridge loading and extraction assembly.

It is another object of the present invention to provide a gas-fired handgun having a gas cartridge loading and extraction assembly designed to economize on the space available for the mechanism and cartridge in the handgun and which does not detract from the normal configuration of the handgun when in its operative condition.

It is another object of the present invention to provide a gas-fired handgun having a gas cartridge loading and extraction assembly wherein the loading of the cartridge into the chamber and its extraction therefrom is accomplished efficiently and economically with only a swinging movement of a lever and which, in the loading condition, automatically enables the gas cap seal at the end of the cartridge to be pierced by the piercing mechanism carried by the handgun and the cartridge to be backed off from the piercing mechanism to enlarge the flow passage.

Additional objects and advantages of the invention will be set forth in part in the description which follows and in part will be obvious from the description, or may be learned by practise of the invention. The objects and advantages of the invention may be realised and attained by means of the instrumentalities and combinations particularly pointed out in the appended claims.

To achieve the foregoing and other objects and in accordance with the purpose of the invention as embodied and broadly described herein, a gas-fired gun according to the present invention comprises a gun frame having a barrel and a handgrip including a fixed body portion, means defining an elongated chamber in the handgrip body portion for receiving a gas-containing cartridge, means carried by the gun adjacent one end of the chamber for piercing one end of the gas cartridge when in the chamber, and a gas cartridge loading assembly forming part of the handgrip and including a lever coupled to the handgrip for pivotal movement about an axis adjacent the opposite end of the chamber between a first position opening the chamber for loading the gas cartridge into the chamber and a second position closing the chamber, the gas cartridge loading assembly further including a cam surface carried by the lever for engaging the opposite end of the gas cartridge during loading thereof into the chamber, the cam surface and the pivotal axis of the lever being located relative to one another along the lever and to the chamber such that movement of the lever from its first position toward its second position enables the cam surface to displace the cartridge towards the chamber and piercing means for piercing the one cartridge end.

Preferably a seat is carried by the lever for engaging the opposite end of the gas cartridge when the lever lies in its second position to enable displacement of the cartridge away from the piercing means when the cartridge is fully loaded into the chamber.

Also, the objects and advantages of the present invention as embodied and broadly described herein are achieved by a gas-fired gun comprising a gun frame having a barrel and a handgrip including a fixed body portion, means defining an elongated chamber in the handgrip body portion for receiving a gas-containing cartridge, means carried by the gun adjacent one end of the chamber for releasably retaining one end of the gas cartridge within the chamber, a gas cartridge extraction assembly forming part of the handgrip and including a lever coupled to the handgrip for pivotal movement about an axis adjacent the opposite end of the chamber and movable between a position closing the chamber and a position opening the chamber enabling extraction of the gas cartridge from the chamber, the gas cartridge extraction assembly further including means at the opposite end of the chamber for engaging the opposite end of the gas cartridge in response to pivotal movement of the lever from its chamber closing position toward its chamber opening position to displace the cartridge outwardly of the chamber and enable release of the one cartridge end from the releasable retaining means.

It is a significant feature of the present invention that the lever in its first or open position relative to the chamber has abutment means cooperable with abutment means carried by the handgrip body to prevent movement of the lever past its first or open position in a direction away from the second or closed position. Significantly, the abutment means carried by the lever and handgrip include a respective limit surface and stop shoulder engageable one with the other when the lever lies in its first or open position. The limit surface on the lever also has a flat configuration forming a continuation of the flat lower end surface of the handgrip when the lever lies in its second or closed chamber position.

As further embodied and broadly described herein, and to further achieve the objects and advantages of this invention, the gas-fired gun of the present invention comprises a gun frame having a barrel and a handgrip including a fixed body portion, means defining an elongated chamber in the handgrip body portion for receiving a gas-containing cartridge, means carried by the gun adjacent one end of the chamber for piercing one end of the gas cartridge when in the chamber and a gas cartridge loading and extraction assembly forming part of the handgrip, the assembly including a lever coupled to the handgrip for pivotal movement about an axis adjacent the opposite end of the chamber between a first position opening the chamber for loading the gas cartridge into and extracting the gas cartridge from the chamber and a second position closing the chamber, a first cam surface carried by the lever for receiving the opposite end of the gas cartridge during loading thereof into the chamber when the lever lies in the first position, the first cam surface and the pivotal axis of the lever being located relative to one another along the lever and to the chamber such that movement of the lever from the first position toward the second position enables the cam surface to displace the cartridge toward the recess and the piercing means for piercing the one cartridge end, and a second cam surface carried by the lever for engaging the opposite end of the cartridge in response to pivotal movement of the lever from the second position toward the first position to displace the cartridge outwardly of the chamber.

The accompanying drawings, which are incorporated herein and constitute a part of the specification, illustrate an embodiment of the invention and, together with the description, serve to explain the principles of the invention.

BRIEF DESCRIPTION OF THE DRAWINGS

FIG. 1 is a side elevational view of a gas-fired handgun incorporating the principles of the present invention;

FIG. 2 is an end elevational view of the handgun illustrated in FIG. 1 and looking from left to right in FIG. 1;

FIG. 3 is an enlarged fragmentary cross-sectional view of a gas cartridge loading and extraction assembly for use with the gas-fired handgun of the present invention and illustrating the lever in a gas cartridge chamber open position;

DESCRIPTION OF A PREFERRED EMBODIMENT

Figure 4:
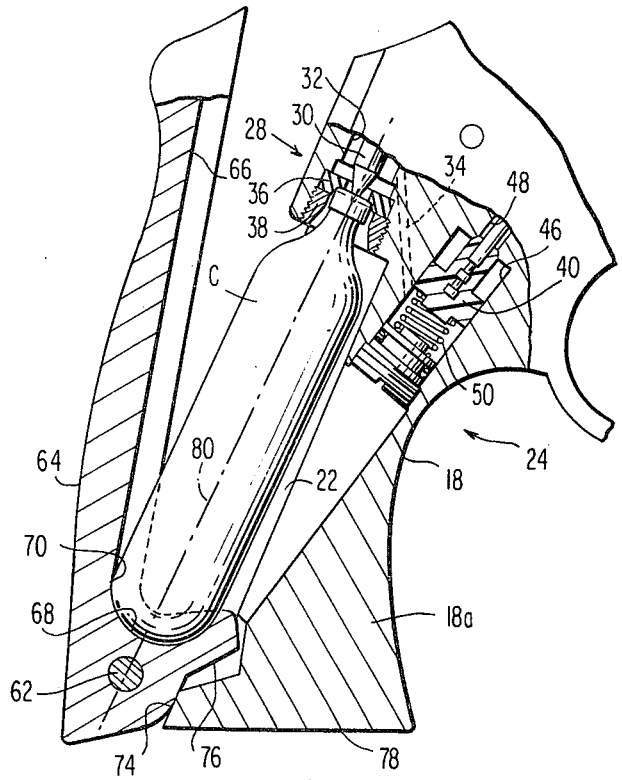
FIG. 4 is a view similar to FIG. 3 illustrating the lever in an intermediate position between the gas cartridge loading position and an operative firing position of the gas-fired handgun.

Reference will now be made in detail to the present preferred embodiment of the invention, an example of which is illustrated in the accompanying drawings.

The preferred embodiment of a gas-fired handgun is shown in FIG. 1 and is represented generally by the numeral 10. Handgun 10 includes a frame 12, barrel 14, a trigger 16 and a handgrip 18. The gas cartridge loading and extraction assembly as embodied herein is generally designated 20.

Figure 5:
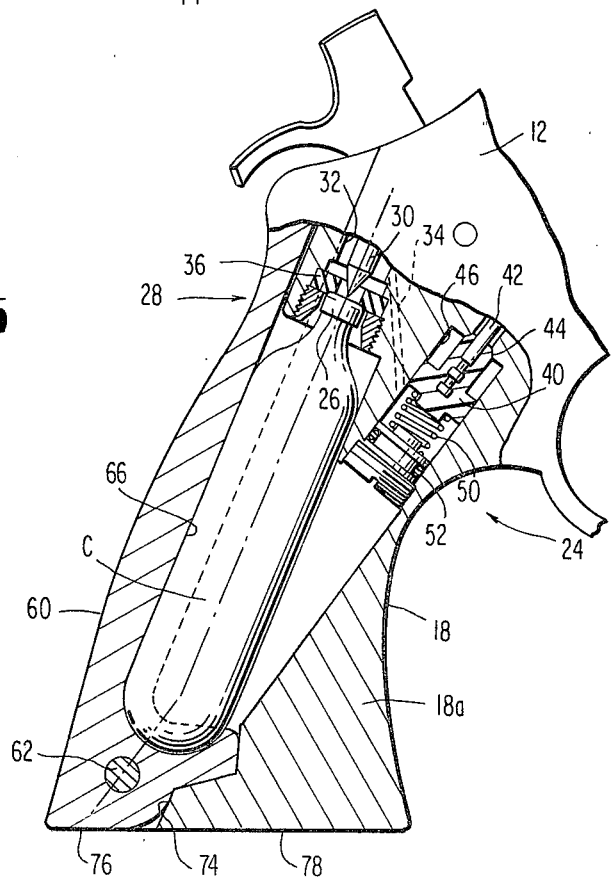
FIG. 5 is a view similar to FIG. 3 illustrating the cartridge in the operative firing condition of the gas-fired handgun.

Referring now to FIG. 5, there is illustrated a gas-containing cartridge C disposed in a chamber 22 of handgrip 18 for supplying gas under pressure to a valve assembly generally designated 24 for firing individual BB shots or pellets from the gun 10. In loading cartridge C into chamber 22 as illustrated in FIG. 3, cap end 26 of cartridge C is pierced by a piercing assembly generally designated 28 to supply the gas under pressure through a valve assembly 24 to fire the BB shot or pellets from the gun. Particularly, piercing assembly 28 includes a piercing cone 30 retained within a bore 32 in communication via passage 34 with valve assembly 24. The cone 30 is retained in bore 32 as illustrated by a retainer washer, not shown. An annular seal 36 is retained in bore 32 by a retaining nut 38. Thus it will be appreciated that piercing assembly 28 provides piercing cone 30 for puncturing the cap end seal 26 of the gas cartridge seal.

Valve assembly 24 includes a valve stem 40 carrying a firing pin 42. The upper end of stem 40 seats against the valve housing to form a seal at 44 between the chamber 46 housing stem 40 and a passage 48. Stem 40 is polygonal in cross section and is biased into sealing engagement against the valve housing by a spring 50. The lower end of the chamber 46 is sealed by an O-ring 52. Consequently, gas from gas cartridge C, when pierced, flows into passages 32 and 43, chamber 46, about the polygonal shaped stem 40 and, when stem 40 is retracted against the bias of spring 50, into passage 48 which directs the gas flow toward barrel 14 to fire a pellet or BB shot from the handgun.

A gas cartridge loading and extraction assembly 20 forms part of the grip 18 and includes a lever 60 coupled to the fixed handgrip body portion 18*a* for pivotal movement about an axis adjacent the opposite end of the chamber from piercing assembly 28. Particularly, lever 60 is pivoted at its lower end about a pin 62 secured to grip body 18. It will be appreciated from a review of FIGS. 1 and 3 that lever 60 forms part of the external surface of handgrip 18 when lever 60 lies in its closed position illustrated in FIGS. 1 and 5. The external surface 64 of lever 60 is configured to provide in conjunction with handgrip body portion 18*a* the normal feel or appearance of a standard handgrip. The interior surface 66 of the lever 60 is shaped preferably to complement the shape of gas cartridge C to retain the same securely within chamber 22 when lever 60 lies in position closing the chamber 22 as illustrated in FIG. 5.

The lower interior end of lever 60 forms a seat 68 preferably complementary in shape to the bulbous lower end of the gas-containing cartridge C. Continuations of the surface of seat 68 form first and second cam surfaces 70 and 72 respectively for reasons noted in the ensuing description of the operation of the gas cartridge loading and extraction assembly hereof.

The lower end of handgrip body portion 18*a* is provided with a shoulder 74. The lower end of lever 60 is flat and forms a limit surface 76. Thus, when lever 60 lies in its second or chamber closed position, limit surface 76 forms a continuation of the planar surface 78 of the handgrip 18 as illustrated in FIG. 1. When lever 60 lies in its first or chamber open position, limit surface 76 engages shoulder 74 providing a stop preventing lever 60 from further pivotal movement away from body portion 18*a* past the first position of the lever illustrated in FIG. 3.

To utilize the gas cartridge loading and extraction assembly hereof, reference is first made to FIG. 3. In FIG. 3, lever 60 is illustrated in its first or chamber opening position. It will be appreciated that limit surface 76 engages limit shoulder 74 on handgrip body 18*a* to prevent pivotal movement of lever 60 about pivot axis 62 beyond the position illustrated. When lever 60 lies in its first position, the end of the gas-filled cartridge C containing the gas cap seal 26 is placed in chamber 22 in proximity to piercing mechanism 28. The opposite bulbous end of the cartridge C is placed along the lower portion of the complementary shaped interior surface 66 of lever 60 as illustrated in FIG. 3. By pivoting lever 60 toward handgrip body portion 18*a* as illustrated in FIG. 4, the first cam surface 70 engages the bulbous end of cartridge C to displace it into chamber 22 and also upwardly such that cap seal end 26 is pierced by cone 30 as illustrated in FIG. 4. Upon continued movement of lever 60 toward its second or closed position illustrated in FIG. 5, seat 68 moves overcenter. This enables cartridge C to back off piercing cone 30. That is, seat 68 moves from one side of a straight line through piercing cone 30 and the pivot pin 62, illustrated in FIG. 4 by the dashed line 80, to the opposite side of the line and enables the pierced end cap 26 of cartridge C to back off piercing cone 30 to provide an enlarged gas passage for flow of gas from cartridge C through seal 36 and to valve 24. The end cap 26, however, remains sealed about seal 36 after the cartridge backs off cone 30. It will be appreciated that in the operative position, with lever 60 closed in chamber 22, the lower end of cartridge C seats on the complementary shaped seat 68.

To extract the cartridge C, lever 60 is pivoted from its position closing chamber 22 to the position opening chamber 22 illustrated in FIG. 1. In the course of that pivoting action, cam surface 72 cams the lower end of cartridge C outwardly of chamber 22 as illustrated in FIG. 4. Continued movement of lever 60 away from handgrip body portion 18*a* causes the end seal cap of cartridge C to withdraw from piercing assembly 28. It will be apparent from a comparison of FIGS. 5 and 3 that cam surface 72 moves from a position on one side of the line 80 between the axis of lever 60 and piercing cone 30 to its opposite side when the lever is moved from its chamber closing position to its chamber opening position. When lever 60 lies in its chamber opening position with limit surface 76 engaging the limit shoulder 74 of the handgrip body portion 18*a*, the cartridge has been partially displaced from chamber 22 to a position where it is readily accessible for further removal from the handgun.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A gas-fired gun comprising:

a gun frame having a barrel and a handgrip including a fixed body portion;

means defining an elongated chamber in said handgrip body for receiving a gas-containing cartridge;

means carried by the gun adjacent one end of said chamber for piercing one end of the gas cartridge when in said chamber, and a gas cartridge loading assembly forming part of said handgrip and including a lever coupled to said handgrip body portion for pivotal movement about an axis adjacent the opposite end of said chamber between a first position opening said chamber for loading the gas cartridge into the chamber and a second position closing the chamber, and a cam surface carried by said lever for directly engaging the opposite end of the gas cartridge during loading thereof into said chamber, said cam surface and the pivotal axis of said lever being located relative to one another along said lever and to said chamber such that movement of said lever from said first position toward said second position enables said cam surface to move the cartridge toward said chamber and said piercing means for piercing the one cartridge end, said lever having a depression therein associated with said cam surface and defining a seat for said opposite end of the cartridge when the lever is in said second position, said seat being movable with the remainder of the lever about said axis as the lever is moved between said positions, said chamber being open and unobstructed from said one end thereof to said seat when the lever is in said second position whereby to define an area for the acceptance of a cartridge that extends from said one end of the chamber to said seat.

2. A gas-fired gun according to claim 1 wherein said seat is so disposed relative to said cam surface as to enable displacement of the cartridge away from said piercing means when the cartridge is fully loaded into said chamber.

3. A gas-fired gun according to claim 2 wherein said seat in said first position of said lever lies on one side of an imaginary straight line intersecting said piercing means and said axis, said seat in said second position of said lever lying on the opposite side of said straight line when said lever is moved from said first position toward said second position.

4. A gas-fired gun according to claim 1 including cooperable abutment means carried by said lever and said handgrip body portion to prevent movement of said lever past said first position in a direction away from said second position.

5. A gas-fired gun according to claim 4 wherein said abutment means includes a stop shoulder carried by said handgrip body portion and a limit surface carried by said lever engageable with said stop shoulder when said lever lies in said first position.

6. A gas-fired gun comprising:

a gun frame having a barrel and a handgrip including a fixed body portion;

means defining an elongated chamber in said handgrip body for receiving a gas-containing cartridge;

means carried by the gun adjacent one end of said chamber for piercing one end of the gas cartridge when in said chamber, and a gas cartridge loading assembly forming part of said handgrip and including a lever coupled to said handgrip body portion for pivotal movement about an axis adjacent the opposite end of said chamber between a first position opening said chamber for loading the gas cartridge into the chamber and a second position closing the chamber, and a cam surface carried by said lever for directly engaging the opposite end of the gas cartridge during loading thereof into said chamber, said cam surface and the pivotal axis of said lever being located relative to one another along said lever and to said chamber such that movement of said lever from said first position toward said second position enables said cam surface to move the cartridge toward said chamber and said piercing means for piercing the one cartridge end, said lever having a portion thereof defining a seat for said opposite end of the cartridge when the lever is in said second position, said seat being movable with the remainder of the lever about said axis as the lever is moved between said positions, said handgrip body portion and said lever having substantially flat lower end surfaces in coplanar relation one to the other to form a flat lower end face for said handgrip when said lever lies in said second position, cooperable abutment means carried by said lever and said handgrip body portion to prevent movement of said lever past said first position in a direction away from said second position thereof, said abutment means including a stop shoulder carried by said lever, said limit surface forming at least part of the flat lower end surface of said lever.

7. A gas-fired gun according to claim 1 wherein said lever forms part of the external surface of said handgrip when in said second position.

8. A gas-fired gun according to claim 1 wherein said handgrip includes upper and lower end portions and forwardly and rearwardly facing surfaces, said lever being pivoted adjacent said lower end portion and said rearwardly facing surface, said lever extending along said rearwardly facing surface toward said upper end portion and forming at least part of said rearwardly facing surface when said lever lies in said second position.

9. A gas-fired gun comprising:

a gun frame having a barrel and a handgrip including a fixed body portion;

means defining an elongated chamber in said handgrip body portion for receiving a gas-containing cartridge;

means carried by the gun adjacent one end of said chamber for releasably retaining one end of the gas cartridge within said chamber and including means for piercing said one end of the cartridge, a gas cartridge extraction assembly forming a part of said handgrip and including a lever coupled to said handgrip body portion for pivotal movement about an axis adjacent the opposite end of said chamber and movable between a position closing said chamber and a position opening said chamber enabling extraction of the gas cartridge from the chamber, said gas cartridge extraction assembly further including surface means at the opposite end of said chamber on said lever and movable therewith laterally outwardly from the chamber about said axis for engaging the opposite end of the gas cartridge in response to pivotal movement of said lever from its chamber closing position toward its chamber opening position to displace the cartridge outwardly of said chamber and enable release of the one cartridge end from said releasable retaining means, said surface means being located on the inboard side of an imaginary line extending between said pivotal axis and said piercing means when the lever is in said position closing the chamber, said lever moving away from said imaginary line in the outboard direction as the lever moves from the chamber closing to the chamber opening position, said chamber being open and unobstructed from said one end thereof to said surface means when the lever is in said chamber closing position whereby to define an area for the acceptance of a cartridge that extends from said one end of the chamber to said surface means.

10. A gas-fired gun according to claim 9 wherein said lever forms a part of the external surface of said handgrip when said lever lies in its recess closing position.

11. A gas-fired gun according to claim 9 wherein said gas cartridge engaging means includes a cam surface carried by said lever for movement therewith, said cam surface being located adjacent the axis of said lever and being movable away from said handgrip body portion when said lever is moved between its recess closing position and its recess opening position.

12. A gas-fired gun according to claim 9 wherein said lever includes a seat carried by said lever adjacent its pivotal axis for receiving the opposite end of the cartridge when said lever lies in its recess closing position, said gas cartridge engaging means including a cam surface adjacent the inner side of said seat and engageable with the cartridge along an inside surface thereof to displace the cartridge outwardly of the recess in response to movement of the lever from its recess closing position toward its recess opening position.

13. A gas-fired gun comprising:

a gun frame having a barrel and a handgrip including a fixed body portion;

means defining an elongated chamber in said handgrip body for receiving a gas-containing cartridge;

means carried by the gun adjacent one end of said chamber for piercing one end of the gas cartridge when in said chamber, and a gas cartridge loading assembly forming part of said handgrip and including a lever coupled to said handgrip body portion for pivotal movement about an axis adjacent the opposite end of said chamber between a first position opening said chamber for loading the gas cartridge into the chamber and a second position closing the chamber, and a cam surface carried by said lever for directly engaging the opposite end of the gas cartridge during loading thereof into said chamber, said cam surface and the pivotal axis of said lever being located relative to one another along said lever and to said chamber such that movement of said lever from said first position toward said second position enables said cam surface to move the cartridge toward said chamber and said piercing means for piercing the one cartridge end, said lever having a portion thereof defining a seat for said opposite end of the cartridge when the lever is in said second position, said seat being movable with the remainder of the lever about said axis as the lever is moved between said positions, said lever including a seat carried by said lever adjacent its pivotal axis for receiving the opposite end of the cartridge when said lever lies in its recess closing position, said gas cartridge engaging means including a cam surface adjacent the inner side of said seat and engageable with the cartridge along an inside surface thereof to displace the cartridge outwardly of the recess in response to movement of the lever from its recess closing position toward its recess opening position, said seat comprising a generally arcuately concave surface for complementally receiving said opposite cartridge end, said cam surface forming a continuation of said seat surface.

14. A gas-fired gun according to claim 9 including means carried by said gun adjacent the one end of said recess defining a passage for egress of gas from the cartridge when in said recess, said gas cartridge engaging means comprising a cam surface carried by said lever for engaging the cartridge along an inside surface thereof, said cam surface in the recess closed position of said lever lying on one side of a straight line intersecting said passage means and the pivotal axis of said lever, said cam surface in the cartridge extracted position of said lever lying on the opposite side of said straight line whereby said cam surface passes through said straight line when said lever is moved from its recess closing position to its cartridge extracted position.

15. A gas-fired gun comprising:

a gun frame having a barrel and a handgrip including a fixed body portion;

means defining an elongated chamber in said handgrip body portion for receiving a gas-containing cartridge, means carried by the gun adjacent one end of said chamber for piercing one end of the gas cartridge when in said chamber and, a gas cartridge loading and extraction assembly forming part of said handgrip, said assembly including a lever coupled to said handgrip for pivotal movement about an axis adjacent the opposite end of said chamber between a first position opening said chamber for loading the gas cartridge into and extracting the gas cartridge from said chamber and a second position closing the chamber, a first cam surface movable about said axis with said lever for receiving and directly engaging the opposite end of the gas cartridge during loading thereof into said chamber when said lever lies in said first position, said first cam surface and the pivotal axis of said lever being located relative to one another along said lever and to said chamber such that movement of said lever from said first position toward said second position enables said cam surface to displace the cartridge toward said chamber and said piercing means for piercing the one cartridge end, and a second cam surface movable about said axis with said lever for engaging the opposite end of the cartridge in response to outward pivotal movement of said lever from said second position toward said first position to laterally engage and displace the cartridge outwardly of said chamber, said lever having a portion thereof defining a generally arcuately concave seat for said opposite end of the cartridge when the lever is in said second position, said seat being movable about said axis with the lever when the latter is moved between said positions and being located between said first and second cam surfaces.

16. A gas-fired gun according to claim 15 wherein said seat is disposed to enable displacement of the cartridge away from said piercing means when the cartridge is fully loaded into said chamber.

17. A gas-fired gun according to claim 15 wherein said second cam surface is located adjacent the inner surface of said chamber between said handgrip body portion and the cartridge when in said chamber.

18. A gas-fired gun according to claim 15 wherein said seat in said first position of said lever lies on one side of a straight line intersecting said piercing means and said pivot axis, said seat in said second position of said lever lying substantially on the opposite side of said straight line whereby said seat passes through said straight line when said lever is moved from said first position toward said second position, said second cam surface being located along said lever for engagement with the cartridge along an inside surface thereof, said second cam surface in said second position of said lever lying on one side of said straight line, said second cam surface in the first position of said lever lying on the opposite side of said straight line whereby said second cam surface passes through said straight line when said lever is moved between its first and second positions.

* * * * *